United States Patent [19]

Kim

[11] 4,418,604

[45] Dec. 6, 1983

[54] PIANO PEDAL EXTENSION

[76] Inventor: Jaime S. Kim, 21875 Hathaway Ave., Apt. #2, Hayward, Calif. 94541

[21] Appl. No.: 396,414

[22] Filed: Jul. 8, 1982

[51] Int. Cl.[3] ..... G10G 7/00; G10C 3/14

[52] U.S. Cl. ..... 84/232

[58] Field of Search ..... 84/230-232, 84/358

[56] References Cited

U.S. PATENT DOCUMENTS

| | | | |
|---|---|---|---|
| 345,005 | 7/1886 | Stretcher | 84/232 |
| 746,101 | 12/1903 | Kind | 84/232 |
| 931,662 | 8/1909 | Virgillito | 84/232 |
| 1,918,510 | 7/1933 | Woodall | 84/232 |
| 2,030,929 | 2/1936 | Miyashita | 84/232 |
| 2,463,910 | 3/1949 | Rydstrom | 84/232 |

*Primary Examiner*—Lawrence R. Franklin

*Attorney, Agent, or Firm*—Linval B. Castle

[57] ABSTRACT

A piano pedal extension including an adjustable height table with a pedal box at the top surface and piano-type auxiliary pedals extending from the box. Connecting rods between the auxiliary pedals and piano pedals are spring-loaded to balance out the weight of the auxiliary pedals and its associated hardware to thereby give the pianist the feeling of the piano pedals. The extension unit includes adjustable clamping members for firmly clamping the unit to an irregular shaped piano pedal box or to the piano box struts.

6 Claims, 4 Drawing Figures

PIANO PEDAL EXTENSION

BRIEF SUMMARY OF THE INVENTION

This invention relates to adjustable extensions for piano pedals and particularly to a novel adjustable pedal extension adaptable for use with grand pianos.

There are many existing types of extension devices for use by students and pianists who are unable to reach the piano pedals. All operate in substantially the same manner by providing a set of auxiliary pedals that are coupled to, and operate the piano pedals. Virtually all of the existing pedal extensions operate only with upright pianos and cannot successfully be connected to grand pianos or the type having a separate pedal box.

The present invention is for a piano pedal extension particularly adaptable for use with grand pianos, and includes a flat top table of adjustable height that may be firmly clamped to the pedal box of a piano such as a concert grand or the so-called baby grand pianos. The table top provides a foot supporting floor for the pianist and has its own pedal box which contains three auxiliary adjustable length pedals which are connected to the piano pedals by adjustable connecting shafts. The adjustable connecting shafts are spring-loaded to substantially balance out the weight of the shafts and auxiliary pedals so that the auxiliary pedals are actually lifted by the normal lifting force of the piano pedals, thus giving to the pianist the same pedal reaction they would obtain from the piano pedals.

DESCRIPTION OF THE DRAWINGS

In the drawings that illustrate a preferred embodiment of the invention.

DETAILED DESCRIPTION

Figure 1:
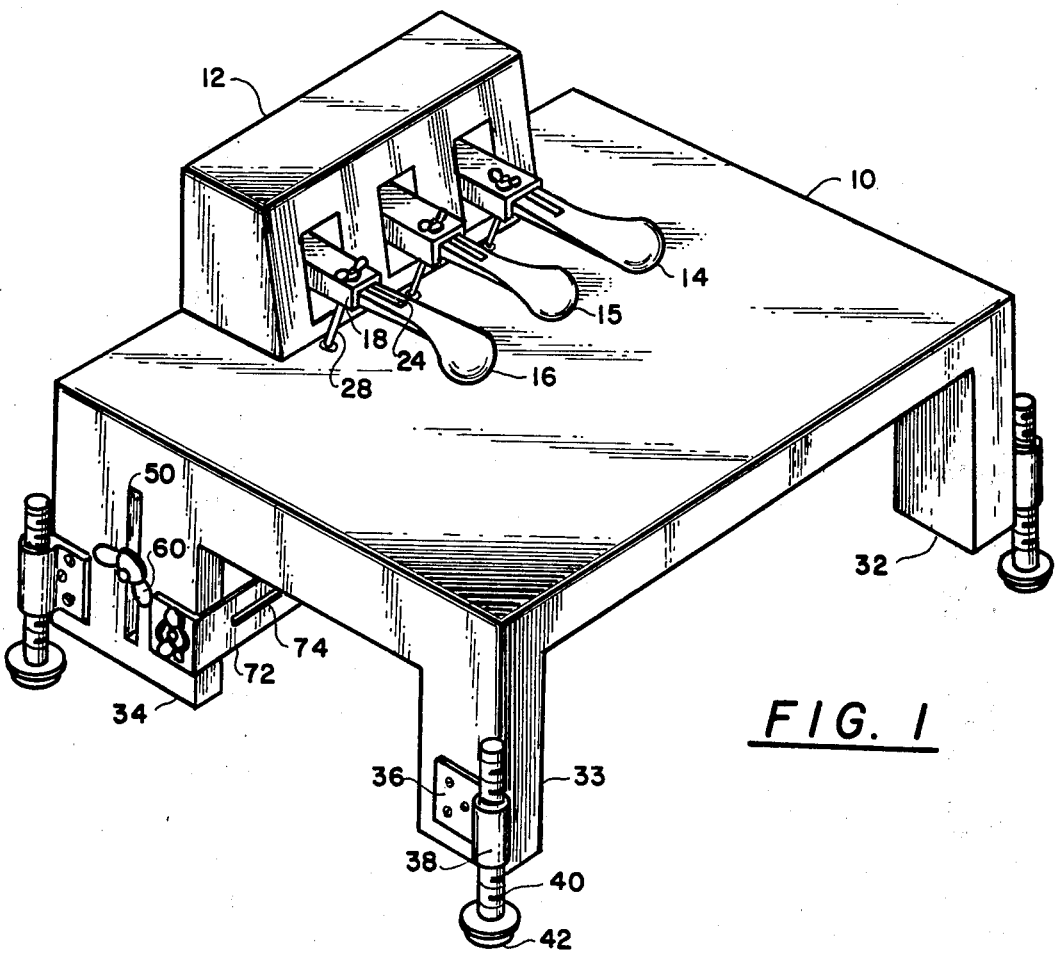
FIG. 1 is a perspective view of the front of the pedal extension.
Figure 3:
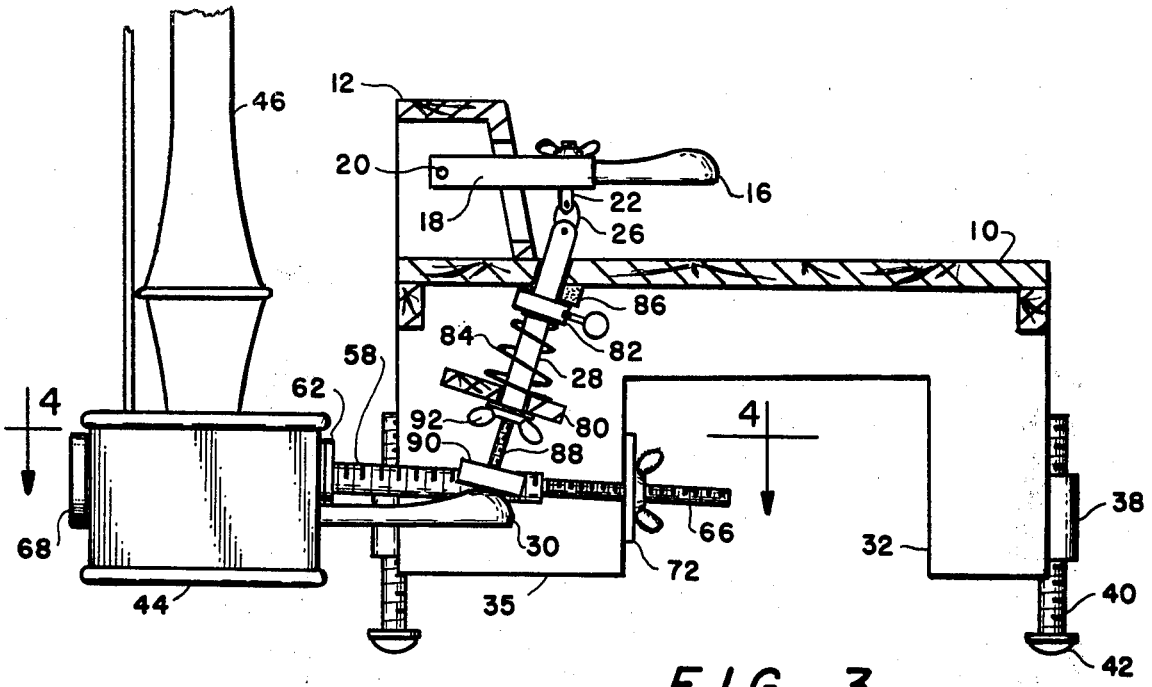
FIG. 3 is a sectional side elevation view taken along the lines 3—3 of FIG. 2.

FIG. 1 is a perspective view illustrating the front of the piano pedal extension which includes an open-sided box or table 10 having a substantially flat horizontal top surface that may be approximately 20 inches wide and 18 inches deep. An extension pedal box 12 is mounted on the table top and is centered at the back edge of the table. The front face of the pedal box 12 may be slanted as illustrated and contains three vertical slots for the passage of the three auxiliary piano type pedals 14, 15 and 16 which horizontally extend out over the surface of the table 10. The lengths of the auxiliary pedals are adjustable within channel sections, such as the section 18, which are pivotally attached at the rear end to the pedal box 12 by a horizontal rod 20 as best illustrated in FIG. 3. As illustrated, the shank portion of the pedal 16 slides into the opposite or front end of the channel section 18 and a screw 22 in a hole in the channel section and a longitudinal slot 24 in the shank of the pedal 16 secures the pedal to the channel and permits longitudinal adjustments of the pedal as desired.

As best shown in FIG. 3, the screw 22 that secures the pedal 16 to the channel section 18 has a slotted lower end for receiving one end of a small elongated link 26 which is pivotally connected to the end of the screw 22 by a suitable pivot pin. As will be subsequently described in greater detail, the lower end of the link 26 is coupled by a suitable pivot pin to the upper end of a tubular actuator shaft 28 which, upon the depressing of the pedal 16, moves to depress the piano pedal 30.

Figure 2:
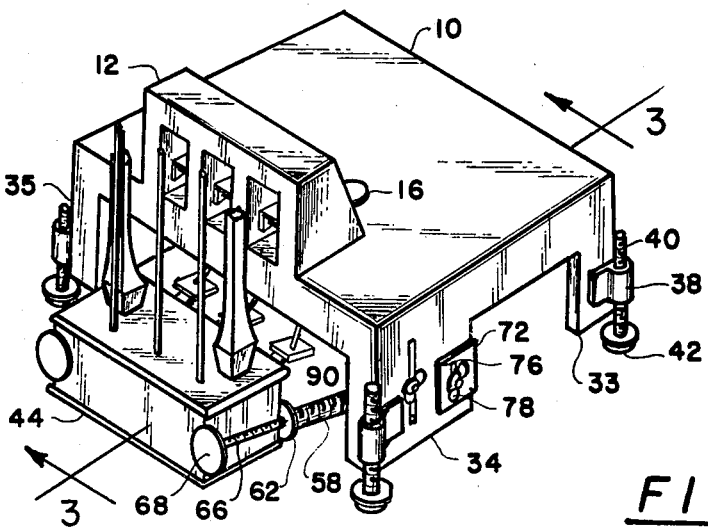
FIG. 2 is a perspective view of the rear of the extension.

As shown in FIGS. 1 and 2, the table 10 has four corner legs 32–35. The two front legs 32 and 33 are relatively small in cross-section and need only be large enough to accommodate the table height-adjusting hardware which comprises a metal mounting plate, such as the plate 36 on the side surface of leg 33, with an incorporated threaded tubular portion 38 which is preferably positioned at the exterior corner of the leg 33 with the longitudinal axis of the threaded tubular portion vertically aligned and parallel with the vertical corner of the leg 33. The threaded portion 38 receives a correspondingly threaded height adjustment rod 40 of suitable length and having at its lower end a rubber tipped caster button 42. As shown in the figures, each of the four table legs is provided with a table height adjustment mechanism identical with that described in connection with the leg 33.

Figure 4:
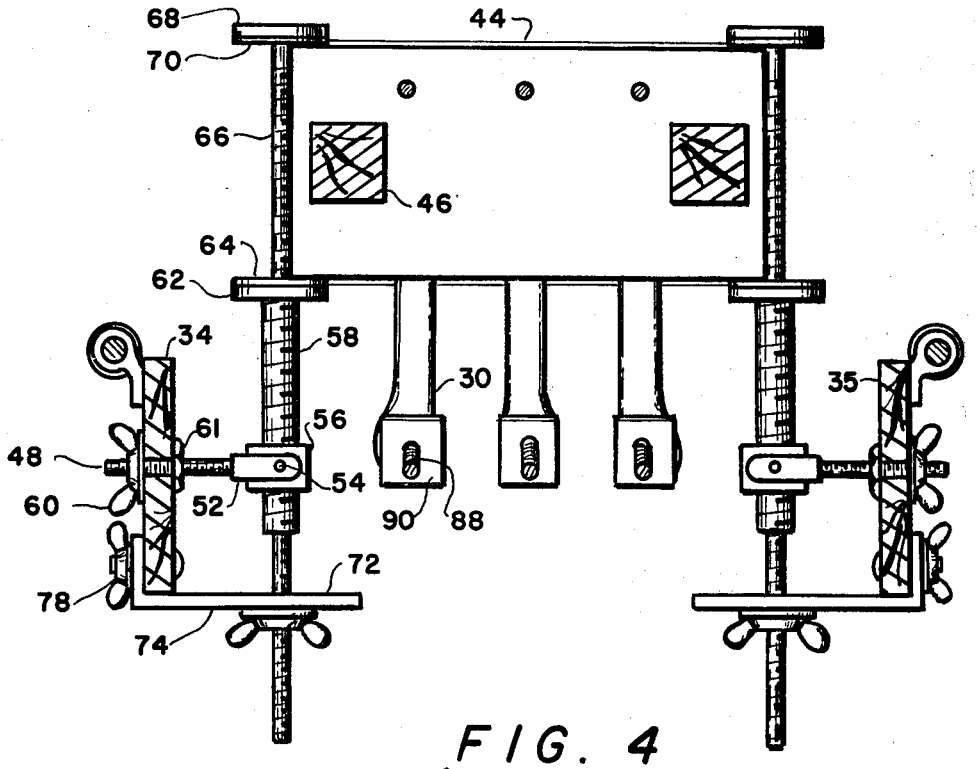
FIG. 4 is a sectional plan view taken along the lines 4—4 of FIG. 3.

An important feature of the piano pedal extension is its ability to be rigidly attached to any irregular shaped part of the pedal box of a grand piano. FIGS. 2, 3 and 4 show the means by which the pedal extension is rigidly coupled to a grand piano pedal box 44 which depends from the piano housing by suitable legs 46. As best shown in the sectional plan view of FIG. 4, a threaded bolt 48 slidably mounted in a vertical slot 50 in the leg 34 supports a U-shaped yoke 52. Vertically mounted pivot pins 54 in the top and bottom arms of the yoke 52 engage the top and bottom surfaces of a square nut 56, the bore of which is threaded to receive a tubular rod 58. Thus, the yoke 52 permits pivotal movement of the nut 56 and its rod 58. The bolt 48 may be vertically adjusted in the slot and then secured by the tightening of the front and rear nuts 60 and 61. Thus the threaded rod 58 is universally adjustable: it may be axially adjusted in or out of the nut 56; it may be pivoted around a vertical axis by the operation of the pivot pins 54; its vertical position may be adjusted through the adjustment in slot 50; and it may be pivoted around the horizontal axis of the bolt 48. Attached to the outboard end of the threaded rod 58 is a metal disc 62 that is preferably faced with a soft resilient material 64 that comes into contact with a surface of the piano pedal box 44.

The threaded rod 58 is a tubular rod with a threaded bore adapted to coaxially receive a smaller diameter threaded rod 66. The outboard end of the threaded rod 66 is provided with a metallic disc 68 and the inside portion of the disc is cushioned with a resilient material so that it may safely grasp the opposite surface of the piano pedal box 44.

The opposite or inboard end of the threaded rod 66 extends through the threaded tubular rod 58 and through a horizontal slot 74 in an angle bracket 72 as best shown in FIG. 1. As illustrated in FIG. 2, the angle bracket 72 extends around to the exterior surface of the leg 34 and is attached thereto by a bolt 78 which extends through a hole in the leg 34 and through a vertical adjustment slot 76 in the angle bracket 72. Thus, by vertically adjusting the angle bracket 72 by the bolt 78 and by horizontally adjusting the end of the rod 66 in the horizontal slot 74 in bracket 72, the rods 66 and 58 may be held in any desired position to grasp the front and rear surfaces of any irregular shaped piano pedal box, such as the piano box 44, or even the piano box legs 46, if desired or more convenient. Obviously, identical hardware is provided on the opposite rear leg 35 to clamp the piano pedal extension to the opposite side of the pedal box.

To properly identify the components of FIG. 3, reference numerals identical to those used in connection with the leg 34 have been employed.

As best illustrated in FIG. 3, a narrow shelf 80 extends between the legs 34 and 35 and is attached thereto at an angle substantially normal to the axis of the actuator tube 28. The tubular shaft 28 passes through holes in the surface of table 10 and through the shelf 80. The holes are preferably lined with felt or other suitable noise insulating material. A tubing clamp 82 is adjustably attached to the exterior of the actuator shaft 28 and a compression coil spring 84 between the shelf 80 and the adjustment clamp 82 operates to force the clamp 82 upward against a washer 86, which may be formed of felt, resilient rubber, or any suitable resilient sound-deadening material. The force exerted by the spring 84 should preferably balance out the weight of the actuator tube 28, the extension pedal 16, and the adjustable threaded rod 88 and resilient cushion 90 which are coupled to the extension actuator shaft 28. With the weights thus canceled by the operation of the adjustable spring 84, the downward and return pressure of the extension pedals will appear to the pianist to be the same as that of the piano pedal 30 without the pedal extension.

The actuator tube 28 is threaded at its lower end to receive the threaded rod 88 which may be adjusted throughout the bore of the actuator tube and locked by a suitable thumb screw 92 according to the adjustments made to the table height by the table's height adjustment rods 40. The threaded rod 88 is provided with a rubber faced pedal block or cushion 90 which rests on the top surface of the piano pedal 30. It will be noted that the actuator tube 28 always moves along the same axis between the pivot pin attaching it to the link 26 and the lined hole through the shelf 80 so that the pedal block 90 cannot be accidentally removed from the pedal 30. It will also be noted that continued use of the auxiliary pedal cannot force the extension pedal assembly away from its original alignment with the piano since it is firmly clamped thereto by the clamping action of the adjustable threaded rods 58 and 66.

What is claimed is:

1. A piano pedal extension comprising:

a table having four corner legs and threaded vertical table height-adjusting rods connected to each of said corner legs;

a pedal box mounted on the top of said table adjacent a first edge thereof, said pedal box having a plurality of vertical openings in the front face thereof, said box pivotally supporting a corresponding number of auxiliary piano-type pedals, one pedal of said plurality passing through each of said vertical openings and extending substantially horizontally outward above said table top;

a plurality of adjustable length connecting shafts each coupled at a first end to one of said plurality of auxiliary pedals, the second end of each connecting shaft being connected to a pedal block for resting on a piano pedal, each of said connecting shafts being constrained for axial movement upon the depressing of the auxiliary pedal coupled thereto;

spring means mounted to each of said plurality of connecting shafts for applying a lifting force that substantially balances the weight of the connecting shaft and its respective auxiliary pedal; and clamping means for firmly clamping said table to at least part of a piano pedal box and in a position at which each of said pedal blocks at the second end of each of said plurality of connecting shafts rests on a piano pedal, said clamping means including:

a threaded tubular member having first and second ends, said member having at its first end a plate for contacting a first surface of a piano pedal box, said tubular member being threaded into a correspondingly threaded swivel nut mounted for pivotal movement about its vertical and horizontal axes and adjustable in a vertical direction and in a horizontal direction perpendicular to the axis of said tubular member; and a threaded rod coaxial with said threaded tubular member and axially adjustable within said tubular member, said threaded rod having at its first end a second plate for engaging a second surface of said piano pedal box that is substantially opposite said first pedal box surface, said threaded rod extending through the second end of said tubular member and through the slot in a horizontally slotted member coupled to said table and horizontally adjustable thereto, said threaded rod being firmly connected in said slot by a correspondingly threaded nut.

2. The piano pedal extension claimed in claim 1 wherein each of said adjustable length connecting shafts is constrained for axial movement by passing each shaft through a first hole in the surface of said table and a second hole in a shelf member beneath said table surface, the first end of each of said shafts being coupled to its respective auxiliary pedal by a link pivotally connected to said pedal and pivotally connected to the first end of the shaft.

3. The pedal extension claimed in claim 2 wherein said spring means is a compression spring coiled around said connecting shaft between said shelf member and an adjustable collar on said shaft located beneath the top of said table.

4. The pedal extension claimed in claim 2 wherein each of said plurality of auxiliary piano-type pedals is adjustable in length from its pivot point in said pedal box.

5. The piano pedal extension claimed in claim 4 wherein the shank portion of said plurality of pedals is longitudinally slotted, said shank portion being slidably positioned in a channel member horizontally pivoted to said pedal box at a first end having adjacent a second end a screw alignable with the slot in the shank of its respective pedal, said screw being coupled beneath said pedal shank to its respective connecting shaft link.

6. The pedal extension claimed in claim 1 wherein said tubular member threaded swivel nut is mounted between the legs of a U-shaped yoke having pivot points that engage two opposite surfaces of said swivel nut, said yoke being mounted to a threaded bolt extending horizontally through a vertical slot in a leg of said table.

* * * * *